US008215234B2

(12) United States Patent
Heiler et al.

(10) Patent No.: US 8,215,234 B2
(45) Date of Patent: Jul. 10, 2012

(54) METHOD FOR ROLLER ADJUSTMENT IN A PRINTING PRESS AND DAMPENING UNIT OF A PRINTING PRESS

(75) Inventors: Peter Heiler, Forst (DE); Michael Münster, Lampertheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 640 days.

(21) Appl. No.: 12/471,793

(22) Filed: May 26, 2009

(65) Prior Publication Data

US 2009/0314171 A1 Dec. 24, 2009

(30) Foreign Application Priority Data

May 26, 2008 (DE) ..... 10 2008 025 081

(51) Int. Cl.
*B41L 35/00* (2006.01)

(52) U.S. Cl. ..... 101/148; 101/147

(58) Field of Classification Search ..... 101/148
See application file for complete search history.

(56) References Cited

U.S. PATENT DOCUMENTS

| | | | |
|---|---|---|---|
| 3,744,414 | A | 7/1973 | Kröchert et al. |
| 6,389,966 | B2 | 5/2002 | Bachmeir et al. |

FOREIGN PATENT DOCUMENTS

| | | | |
|---|---|---|---|
| DE | 2054678 | A1 | 10/1972 |
| DE | 4103742 | A1 | 8/1992 |
| DE | 19732497 | A1 | 2/1999 |
| DE | 102005015791 | A1 | 12/2005 |

*Primary Examiner* — Joshua D Zimmerman
(74) *Attorney, Agent, or Firm* — Laurence A. Greenberg; Werner H. Stemer; Ralph E. Locher

(57) ABSTRACT

A method for roller adjustment in a printing press includes providing a first roller, a second roller and a third roller. The second roller bears both against the first roller and against the third roller and is oriented in an axially nonparallel manner relative to the third roller. The first roller is displaced into a position in which the first roller is oriented in an axially nonparallel manner relative to the third roller. A dampening unit for carrying out the method is also provided.

11 Claims, 2 Drawing Sheets

METHOD FOR ROLLER ADJUSTMENT IN A PRINTING PRESS AND DAMPENING UNIT OF A PRINTING PRESS

CROSS-REFERENCE TO RELATED APPLICATION

This application claims the priority, under 35 U.S.C. §119, of German Patent Application DE 10 2008 025 081.3, filed May 26, 2008; the prior application is herewith incorporated by reference in its entirety.

BACKGROUND OF THE INVENTION

Field of the Invention

The present invention relates to a method for roller adjustment in a printing press and to a dampening unit of a printing press, in which the dampening unit is suitable for carrying out the method.

Dampening units of printing presses as a rule include a plurality of rollers which bear against one another under pressure. As a result of the pressure, the rollers are deflected axially. The deflection of the rollers in turn results in nonuniform metering of dampening solution along the roller nip. Various countermeasures are known in order to counteract that undesired effect, namely so-called winding of one roller around the other roller and so-called offsetting of one roller relative to the other roller.

Winding is explained in German Published, Non-Prosecuted Patent Application DE 205 4678, corresponding to U.S. Pat. No. 3,744,414. In the dampening unit which is described in that document, a metering roller is mounted in levers which are disposed in such a way that they can be pivoted about the rotational axis of a dip roller. As a consequence of one of the levers being pivoted, a roller end of the metering roller is pivoted along an arcuate movement line and the metering roller is wound around the dip roller in a helical manner to a small extent.

Offsetting is explained in German Published, Non-Prosecuted Patent Application DE 10 2005 015 791 A1, corresponding to U.S. Pat. No. 7,225,735. In the dampening unit which is described in that document, the two roller ends of the roller to be offset are displaced along a straight line in an opposite direction with respect to one another. As a consequence of that displacement, the geometric rotational axis of the offset roller is oriented obliquely relative to the geometric rotational axis of the neighboring roller, against which the offset roller bears.

In each of the two documents which are cited above, the roller which is to be wound or offset bears only against a single roller. In both documents, only countermeasures are shown which counteract the roller deflection in the roller nip which is formed by the metering roller together with the dip roller and in no other roller nip.

An unfavorable aspect of the prior art is that the roller deflection which becomes active in the roller nip which an applicator roller forms together with its respective neighboring roller, is not taken into consideration. It has not yet been recognized in the prior art that the roller deflection which is active in that roller nip also has a great influence on the uniformity of the dampening of the printing form.

SUMMARY OF THE INVENTION

It is accordingly an object of the invention to provide an improved method for roller adjustment in a printing press and a dampening unit of a printing press that is suitable for carrying out the method, which overcome the hereinafore-mentioned disadvantages of the heretofore-known methods and devices of this general type and with which in particular very uniform dampening of the printing form can be achieved.

With the foregoing and other objects in view there is provided, in accordance with the invention, a method for roller adjustment in a printing press. The method comprises providing a first roller, a second roller and a third roller, applying the second roller against both the first roller and the third roller, orienting the second roller in an axially nonparallel manner relative to the third roller, and displacing the first roller into a position oriented in an axially nonparallel manner relative to the third roller.

In the method according to the invention, not only is the roller deflection of the first roller compensated for, but also the roller deflection of the second roller. Accordingly, not only is the liquid film evened out in the axial direction or over the printing width, in which the liquid film is transferred from the first roller to the second roller in the roller nip that is formed by the first roller together with the second roller, but also the liquid film which is transferred from the second roller to the third roller in the roller nip that is formed by the second roller together with the third roller.

In accordance with another mode of the invention, only one of the two ends of the first roller is displaced during the displacement of the first roller. In a further mode, that end of the first roller which was displaced during the displacement of the first roller is moved along a circular arc during this displacement. In an added mode, the first roller is wound axially in a helical manner around the second roller during the displacement of the first roller. The first roller is therefore wound around the second roller. In an additional mode, the second roller is oriented in an axially oblique manner relative to the third roller. The second roller is therefore offset. The magnitude of the oblique position of the second roller relative to the third roller can be nonvariable. Alternatively, it can also be possible that the magnitude of the offset of the second roller relative to the third roller can be set.

With the objects of the invention in view, there is also provided a dampening unit of a printing press, in particular for carrying out the method according to the invention. The dampening unit comprises a first roller, a second roller and a third roller. The second roller bears against both the first roller and the third roller. The second roller is oriented in an axially nonparallel manner relative to the third roller.

The special feature of the dampening unit according to the invention is to be seen in the fact that the second roller which is oriented in an axially nonparallel manner is an intermediate roller which bears not only against a single neighboring roller, but rather against two neighboring rollers. The dampening unit according to the invention affords the structural preconditions for carrying out the method according to the invention.

In accordance with another feature of the dampening unit of the invention, the second roller is oriented in an axially oblique manner relative to the third roller. In this case, the second roller is offset relative to the third roller. In a further development, the first roller is a dip roller which scoops dampening solution out of a water fountain. In a concomitant development, the third roller is an applicator roller which bears against a printing form cylinder.

Other features which are considered as characteristic for the invention are set forth in the appended claims.

Although the invention is illustrated and described herein as embodied in a method for roller adjustment in a printing press and a dampening unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. Further structurally and functionally advantageous developments of the method according to the invention and of the dampening unit according to the invention result from the following description of one exemplary embodiment and the associated drawing.

DETAILED DESCRIPTION OF THE INVENTION

Figure 1:
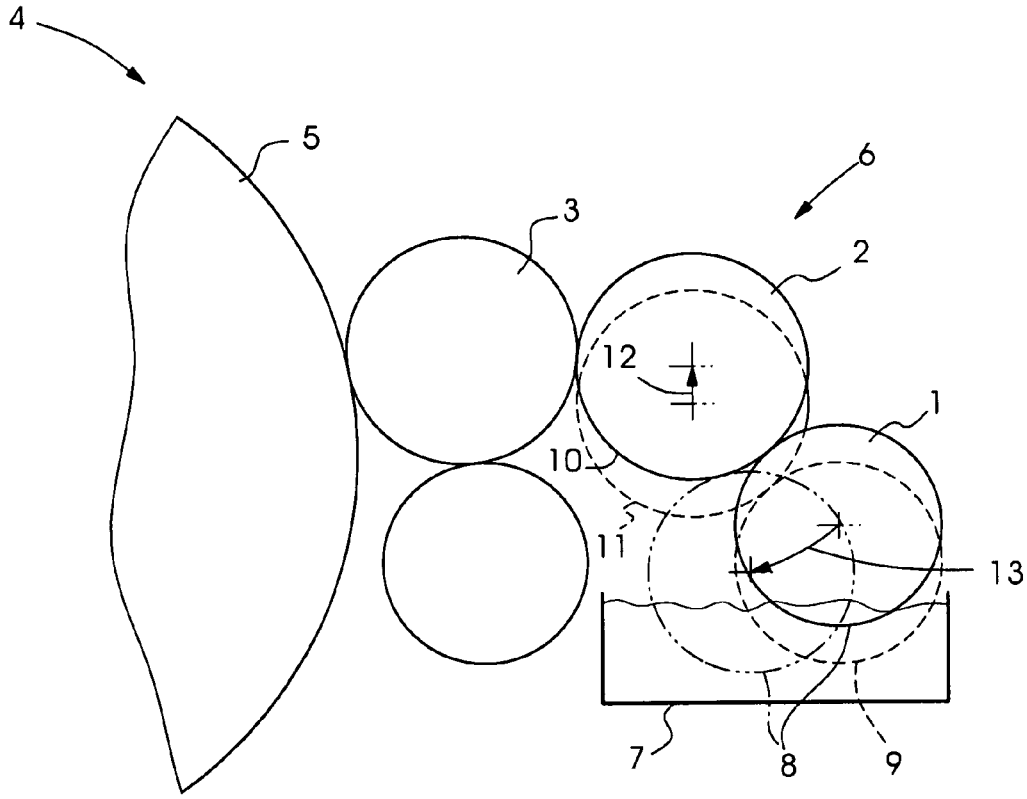
FIG. 1 is a fragmentary, diagrammatic, side-elevational view of a dampening unit having a dip roller, a metering roller and an applicator roller.

Referring now to the figures of the drawings in detail and first, particularly, to FIG. 1 thereof, there is seen a printing press 4 having a printing form cylinder 5 and a dampening unit 6 for dampening the printing form cylinder 5. The printing press 4 is a lithographic offset printing press for printing sheets. The dampening unit 6 includes a dip roller 1 as a first roller, a metering roller 2 as a second roller and an applicator roller 3 as a third roller. Apart from the metering roller 2, a distributor roller which is not denoted in greater detail and oscillates axially, bears against the applicator roller 3. The dip roller 1 is disposed in a water fountain 7, in order to scoop dampening solution from the latter. The metering roller 2 is disposed as an intermediate roller between the dip roller 1 and the applicator roller 3 and transfers the dampening solution from the former to the latter.

Figure 2:
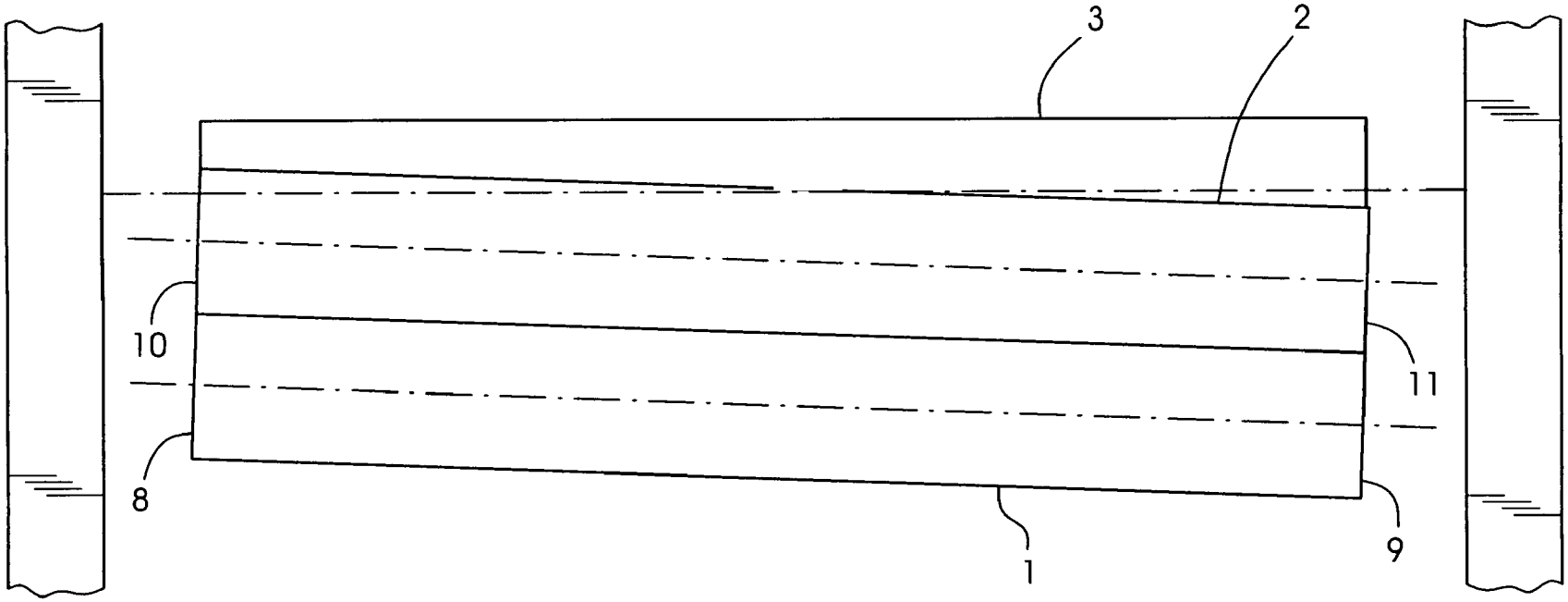
FIG. 2 is a fragmentary, plan view of the rollers of the dampening unit.

FIG. 2 does not also show the printing form cylinder 5, for reasons of improved clarity. FIG. 2 shows that the rollers 1, 2 and 3 are disposed between a frame wall (not indicated by a reference numeral) on an operating side of the printing press 4 and a frame wall (likewise not indicated by a reference numeral) on a drive side of the printing press 4. An end of the dip roller 1, which lies on the operating side, is indicated by reference numeral 8 and is referred to as an operating side dip roller end 8 in the following text. An end of the dip roller 1, which lies on the drive side, is indicated by reference numeral 9 and is referred to as a drive side dip roller end 9 in the following text. An end of the metering roller 2, which lies on the operating side, is indicated by reference numeral 10 and is referred to as an operating side metering roller end 10 in the following text. An end of the metering roller 2, which lies on the drive side, is indicated by reference numeral 11 and is referred to as a drive side metering roller end in the following text.

It can be seen from FIG. 2 that the geometric rotational axis of the dip roller 1 is not oriented parallel to the geometric rotational axis of the applicator roller 3, and that the geometric rotational axis of the metering roller 2 is likewise not oriented parallel to the geometric rotational axis of the applicator roller 3. The geometric rotational axis of the metering roller 2 is oriented in a skewed manner relative to the geometric rotational axis of the applicator roller 3.

FIG. 1 shows the drive side metering roller end 11 as a broken line and the operating side metering roller end 10 as a solid line. It can be seen that the operating side metering roller end 10 is displaced upward along a vertical, straight line 12 relative to the drive side metering roller end 11. The magnitude of the offset between the operating side metering roller end 10 and the drive side metering roller end 11, in which the magnitude is to be measured along the line 12, is nonvariable for structural reasons in the exemplary embodiment shown and could be capable of being set according to one modification, with the result that the magnitude of the offset of the metering roller 2 relative to the applicator roller 3 can be set. FIG. 1 shows the drive side dip roller end 9 as a broken line and shows the operating side dip roller end 8 as a solid line in one possible adjustment position and as a dot-dash line in another possible adjustment position. That adjustment position of the operating side dip roller end 8 which is shown by way of a solid line corresponds to a minimum winding of the dip roller 1 around the metering roller 2, and that adjustment position of the operating side dip roller end 8 which is shown by way of a dot-dash line corresponds to a maximum winding of the dip roller 1 around the metering roller 2. The operating side dip roller end 8 can be set along a circular arc 13 in an infinitely variable manner into the two adjustment positions shown in the drawing and into each of the intermediate positions which lie between them. The circular arc 13 extends concentrically with respect to that circumferential line of the metering roller 2 which lies at the operating side metering roller end 10. When the operating side dip roller end 8 pivots along the circular arc 13, the drive side dip roller end 9 retains its position relative to the metering roller 2 in a substantially unchanged state.

Instead of the above-described helical winding of the dip roller 1 around the metering roller 2, according to a non-illustrated modification, the dip roller 1 could be offset relative to the metering roller 2 to the same extent as the metering roller 2 is offset relative to the applicator roller 3. In the case of this offset, the operating side dip roller end 1 would not be displaced along the circular arc 13, but instead along a straight line. The imaginary pivot axis, about which the dip roller 1 would be pivoted during its possible offsetting, would lie at the drive side dip roller end 9.

As a result of the winding of the dip roller 1 around the metering roller 2, in the region of the center of the axial length of the rollers 1, 2, the axial spacing which exists between those two rollers is reduced, and therefore a metering gap which is formed by those two rollers 1, 2 together is also reduced. As a result of that position of the operating side metering roller end 10 which is raised with respect to the drive side metering roller end 11, a movement space is obtained below the operating side metering roller end 10 for the operating side dip roller end 8, with the result that the depth of the water fountain 7 can be kept comparatively low despite the winding of the dip roller 1. Without the raised position of the operating side metering roller end 10, the water fountain would need to have a deeper configuration, in order to ensure that the dip roller 1 does not come into contact with the bottom of the water fountain 7 during its downward movement along the circular arc 13. As a result of the fact that the depth of the water fountain 7 can be kept relatively low, installation space is available below the water fountain 7 for other assemblies of the printing press 4. When the metering roller 2 rolls on the applicator roller 3, there is slip between the slower circumferential surface of the metering roller 2 and the quicker circumferential surface of the applicator roller 3. As a result of the oblique position of the metering roller 2 relative to the applicator roller 3, disruptions which are caused by the contact of the applicator roller 3 with the printing form cylinder 5 are reduced and so-called the ghosting behavior of the dampening unit 6 is influenced positively.

It goes without saying that, in the above description, the terms operating side and drive side can be exchanged with one another or can be referred to as first machine side and second machine side.

The invention claimed is:

1. A method for roller adjustment in a printing press, the method comprising the following steps:

providing a first roller, a second roller and a third roller;

applying the second roller against both the first roller and the third roller;

orienting the second roller in an axially nonparallel manner relative to the third roller; and displacing the first roller into a position oriented in an axially nonparallel manner relative to the third roller.

2. The method according to claim 1, which further comprises displacing only one of two ends of the first roller during the step of displacing the first roller.

3. The method according to claim 2, which further comprises moving the one end of the first roller, displaced during the step of displacing the first roller, along a circular arc during the step of displacing the one end of the first roller.

4. The method according to claim 1, which further comprises winding the first roller axially in a helical manner around the second roller during the step of displacing the first roller.

5. The method according to claim 1, which further comprises orienting the second roller in an axially oblique manner relative to the third roller.

6. A dampening unit of a printing press, the dampening unit comprising:

a first roller, a second roller and a third roller;

said second roller bearing against both said first roller and said third roller;

said second roller being oriented in an axially nonparallel manner relative to said third roller; and said first roller configured to be displaced into a position oriented in an axially nonparallel manner relative to said third roller.

7. The dampening unit according to claim 6, wherein said second roller is oriented in an axially oblique manner relative to said third roller.

8. The dampening unit according to claim 7, which further comprises a water fountain, said first roller being a dip roller scooping dampening solution out of said water fountain.

9. The dampening unit according to claim 7, wherein said third roller is an applicator roller for bearing against a printing form cylinder.

10. The dampening unit according to claim 8, wherein said third roller is an applicator roller for bearing against a printing form cylinder.

11. A dampening unit of a printing press, the dampening unit comprising:

a first roller, a second roller and a third roller configured to carry out the method according to claim 1;

a second roller bearing against both said first roller and said third roller; and said second roller being oriented in an axially nonparallel manner relative to said third roller.

* * * * *